United States Patent [19]

Tissari

[11] Patent Number: 4,609,435

[45] Date of Patent: Sep. 2, 1986

[54] PROCESS AND EQUIPMENT IN THE FORMING OF PAPER WEB

[75] Inventor: Martti Tissari, Jyväskylä, Finland

[73] Assignee: Valmet Oy, Finland

[21] Appl. No.: 693,170

[22] Filed: Jan. 22, 1985

[30] Foreign Application Priority Data

Jan. 20, 1984 [FI] Finland ..... 840246

[51] Int. Cl.[4] ..... D21F 1/00

[52] U.S. Cl. ..... 162/203; 162/211; 162/301; 162/352

[58] Field of Search ..... 162/203, 205, 208, 211, 162/300, 301, 303, 348, 352

[56] References Cited

U.S. PATENT DOCUMENTS

| | | | |
|---|---|---|---|
| 3,839,143 | 10/1974 | Suckow | 162/203 |
| 3,846,233 | 11/1974 | Kankaanpaa | 162/312 |
| 3,856,618 | 12/1974 | Roell | 162/300 |
| 3,994,774 | 11/1976 | Halme et al. | 162/301 |
| 4,125,428 | 11/1978 | Phelps | 162/301 |
| 4,146,424 | 3/1979 | Justus | 162/301 |
| 4,414,061 | 11/1983 | Trufitt et al. | 162/301 |
| 4,417,950 | 11/1983 | Bubik et al. | 162/300 |
| 4,447,295 | 5/1984 | Bubik et al. | 162/300 |
| 4,517,054 | 5/1985 | Hujala et al. | 162/301 |
| 4,523,978 | 6/1985 | Pullinen | 162/300 |

FOREIGN PATENT DOCUMENTS

| | | | |
|---|---|---|---|
| 1336713 | 11/1973 | United Kingdom | 162/301 |

*Primary Examiner*—S. Leon Bashore
*Assistant Examiner*—K. M. Hastings
*Attorney, Agent, or Firm*—Steinberg & Raskin

[57] ABSTRACT

A process in the forming of a paper web, the dewatering of the pulp web, and of the paper web being formed comprises feeding the pulp suspension jet from the slice of the headbox into a gap formed by two wires, the gap becoming narrower in the feeding direction of the pump suspension jet. Water is removed from the pulp web when the web is in compression between the carrying wire and the covering wire within the twin-wire forming zone, which begins immediately after the feeding gap. The twin-wire forming zone is curved towards the loop of the carrying wire with a curve radius which is selected large enough so that the wire tensioning pressure resulting from it and acting upon the pulp web becomes low and the water removed from the pulp web is not splashed from the inside surface of the wire loop by the effect of centrifugal force dependent upon the curve radius. The joint run of the wires is passed over an open-surfaced forming roller, so as to be curved within a relatively small angle towards the loop of the covering wire. The joint run of the wires is passed over a forming roller, so as to be curved towards the loop of the carrying wire. The formed web is detached from the wire and transferred into the press section of the paper machine. A specifically structured twin wire former carries out the process.

12 Claims, 14 Drawing Figures

PROCESS AND EQUIPMENT IN THE FORMING OF PAPER WEB

BACKGROUND OF THE INVENTION

The present invention relates to a process and equipment used in the forming of a paper web. More particularly, the invention relates to a process in the forming of paper web and in the dewatering of the pulp web and of the paper web formed.

The invention further relates to a twin wire former intended for carrying out the process of the invention. The former comprises a loop of a carrying wire guided by the breast roller, the forming roller and the guide rollers, as well as a loop of a covering wire guided by the breast roller, the forming roller and the guide rollers. The wire loops together form a forming gap between and in connection with the breast rollers. The pulp suspension jet is supposed to be fed into the forming gap. The forming gap is followed by a joint twin-wire forming and dewatering zone of the wires. The web is arranged after the zone, so as to follow along with the carrying wire, from which the web is detached and passed into the drying section of the paper machine.

As the running speeds of paper machines are increased, several problems in the forming of the web are accentuated even further. Phenomena that act in the forming section of a paper machine upon the fiber mesh and upon the water that is still relatively free in connection with said mesh, in particular the force effects, are usually intensified in proportion to the second power of the web speed. The maximum web speeds of the present newsprint machines are of the order of 1200 meters per minute. Newsprint machines are, however, being planned in which a web speed of up to about 1500 m/min is aimed at. Such increase in speed causes several problems, which will be discussed in the following.

A so-called hybrid former is a former in which the forming zone has a single-wire initial portion, onto which the headbox feeds the pulp suspension jet. A twin wire forming zone follows the single-wire portion. A problem of hybrid formers, as of four-drinier formers, is that at high web speeds splashes occur in the pulp web. These splashes result from the collision angle between the pulp jet and the forming board and, on the other hand, from the scattering of the highly turbulent pulp jet as said jet meets the forming board. The reach of the splashes in the direction of the pulp web is quite long, and these splashes cause marks in the pulp web being formed and thereby deteriorates the quality of the paper produced. On the other hand, the foil pulses used for the removal of water from a fourdrinier former become so high at high speeds that this causes splashing which deteriorates the formation of the web. As is well known, the foil pulsation increases proportionally to the second power of the speed. In order that the pulsation be maintained below the splashing limit at a high speed, the foil angles must be made so small (approaching the angle 0°) that an adequate dewatering capacity is not obtained.

It is a further drawback of a fourdrinier former that transverse profile defects present in the discharge jet may be accentuated further on the fourdrinier wire, for example, due to diagonal flow components in the pulp slurry (so-called plowings on the wire board), or in the form of stronger longitudinal streaks.

It is a common opinion that the variations in grammage in twin gap formers remain lower than in fourdrinier formers or hybrid formers. This is due to the fact that in gap formers, the jet is supplied straight into the gap, wherein the pulp jet is immediately "supported" between two wires, so that no transverse flows can arise, which transverse flows would intensify the defects in profile.

When the speeds of paper machines, in particular of newsprint machines, increase, uniformity of the web is, besides being a factor of paper quality, also important, since uniformity of the web has an ever higher effect on the running quality of the paper machine, because the weakest portions of the web are, as a rule, the cause of the breaks.

SUMMARY OF THE INVENTION

The principal object of the invention is to provide a process and equipment in the forming of a paper web which are suitable for high web speeds up to 1500 m/min, and even higher speeds.

An object of the invention is to provide a process and a former that are particularly well suitable for the production of low-grammage printing papers, such as newsprint and LWC-paper, in particular when the grammage of the papers is within the range of 30 g/m$^2$ to 60 g/m$^2$. Developmental progress is continuously lowering the grammages, which imposes ever higher requirements on the uniformity of paper. At the present time, 45 g/m$^2$ is common for newsprint, but, in the near future, it will be 40 g/m$^2$ and lower.

Another object of the invention is to provide a web forming process and a former via which an improved formation and sheet forming is achieved, but in which, nevertheless, a retention of at least equal standard is accomplished as in the prior art formers.

Still another object of the invention is to provide a web forming process and a former via which a uniform distribution of fines and fillers is obtained, so that the opposite surfaces of the web are as equal to each other as possible.

Yet another object of the invention is to provide a web forming process and a former via which the porosity of the paper produced is low whereby there are no so-called pinholes.

Another object of the invention is to provide a web forming process and a former via which the offset printing properties of the paper produced are good.

Still another object of the invention is to provide a web forming process and a former via which a sufficiently high dry solids content is accomplished after the wire section.

The foregoing objects are achieved by the web forming process and the former, whose most important characteristics are described as follows.

The process of the invention comprises the following steps carried out in the following sequence.

(a) The pulp suspension jet is fed from the slice of the headbox of the paper machine into a gap formed by two wires. The gap becomes narrower in the direction of feed of the pulp suspension jet. Water is removed from the pulp web when said web is in compression between the carrying wire and the covering wire within the twin-wire forming zone, which is immediately after the feeding gap.

(b) The twin-wire forming zone is made curved with a relatively large curve radius towards the loop of the carrying wire. The curve radius is selected large enough so that the wire tensioning pressure resulting from it and acting upon the pulp web becomes low and the water removed from the pulp web is not, at least not to a disturbing extent, splashed from the inside surface of the wire loop, by the effect of centrifugal force dependent on the curve radius, within the twin-wire forming or dewatering zone.

(c) The joint run of the wires is passed over an open-surfaced forming roller, so as to be curved within a relatively small angle towards the loop of the covering wire.

(d) The joint run of the wires is further passed over a forming roller within a certain sector, so as to be curved towards the loop of the carrying wire.

(e) The formed web is detached from the wire and, in a manner known in itself, is transferred into the press section of the paper machine.

The former of the invention comprises a combination of the following components.

(a) Dewatering equipment is fitted within the twin-wire portion substantially immediately after the forming gap inside the loop of the carrying wire. The dewatering equipment is fitted so as to guide the joint run of the wires, so that such run is curved with a curve radius towards the carrying wire loop. The curve radius is within the range of R=5 m to 50 m, preferably R=10 m to 20 m.

(b) An open-surfaced forming roller is fitted substantially immediately after the dewatering equipment inside the loop of the covering wire. The twin-wire run is arranged on the forming roller so as to be curved within a small angle towards the loop of the covering wire.

(c) A forming roller is fitted in proximity with the forming roller inside the loop of the carrying wire. The joint run of the wires is arranged on the forming roller, so as to be curved towards the loop of the carrying wire within a certain angle.

BRIEF DESCRIPTION OF THE DRAWINGS

For a fuller understanding of the invention, reference is had to the following description, taken in connection with the accompanying drawings, in which.

DESCRIPTION OF PREFERRED EMBODIMENTS

Figure 1:
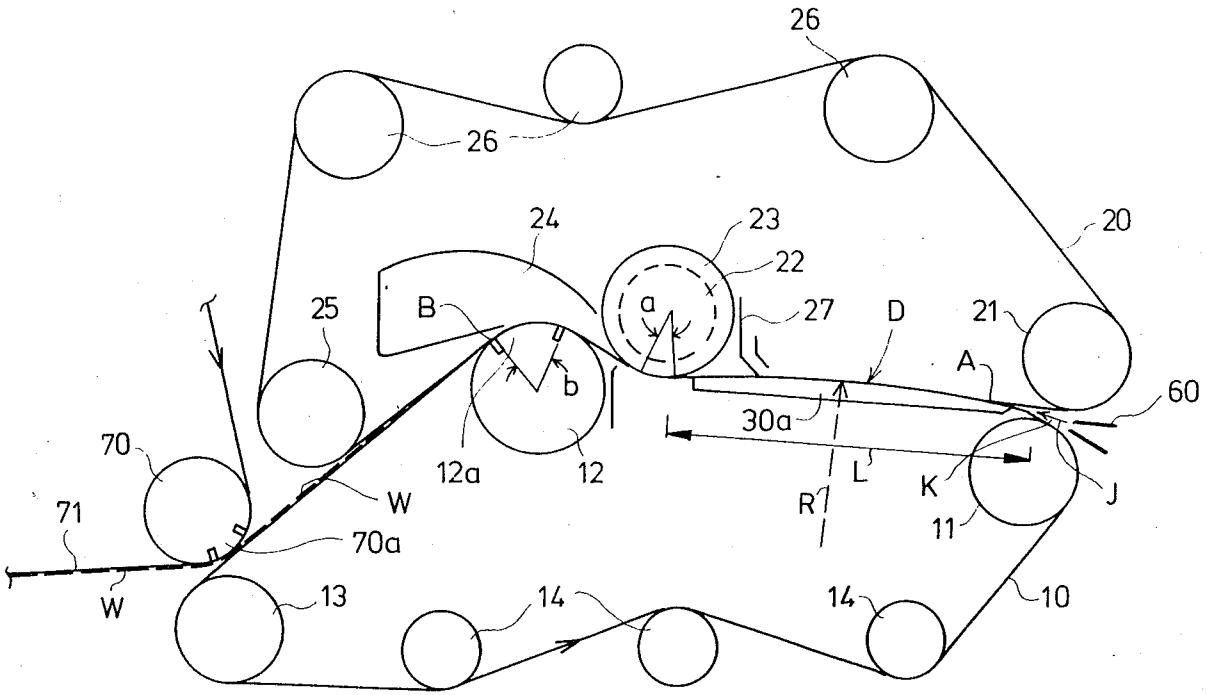
FIG. 1 is a schematic side view of an embodiment of the invention, in which the twin-wire forming zone is substantially horizontal.
Figure 2:
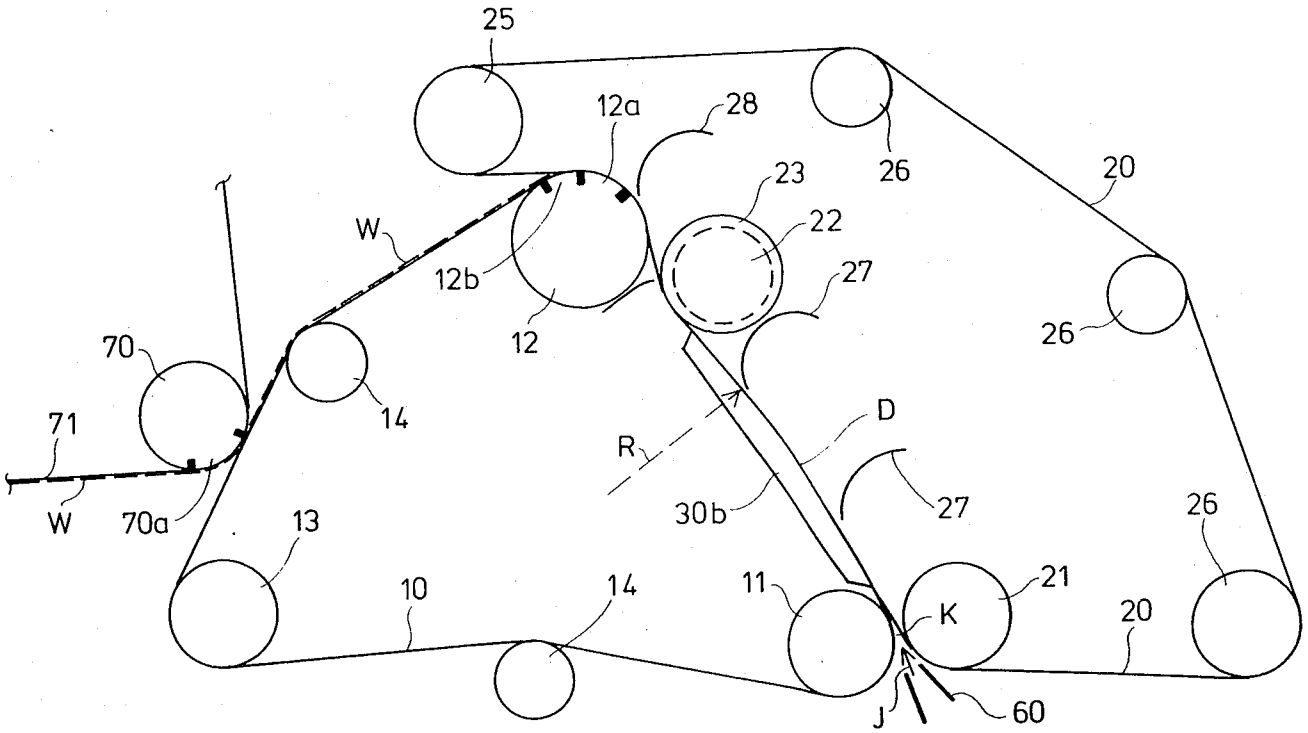
FIG. 2 is a schematic side view of another embodiment of the invention, in which the twin-wire forming zone rises diagonally upward.
Figure 3:
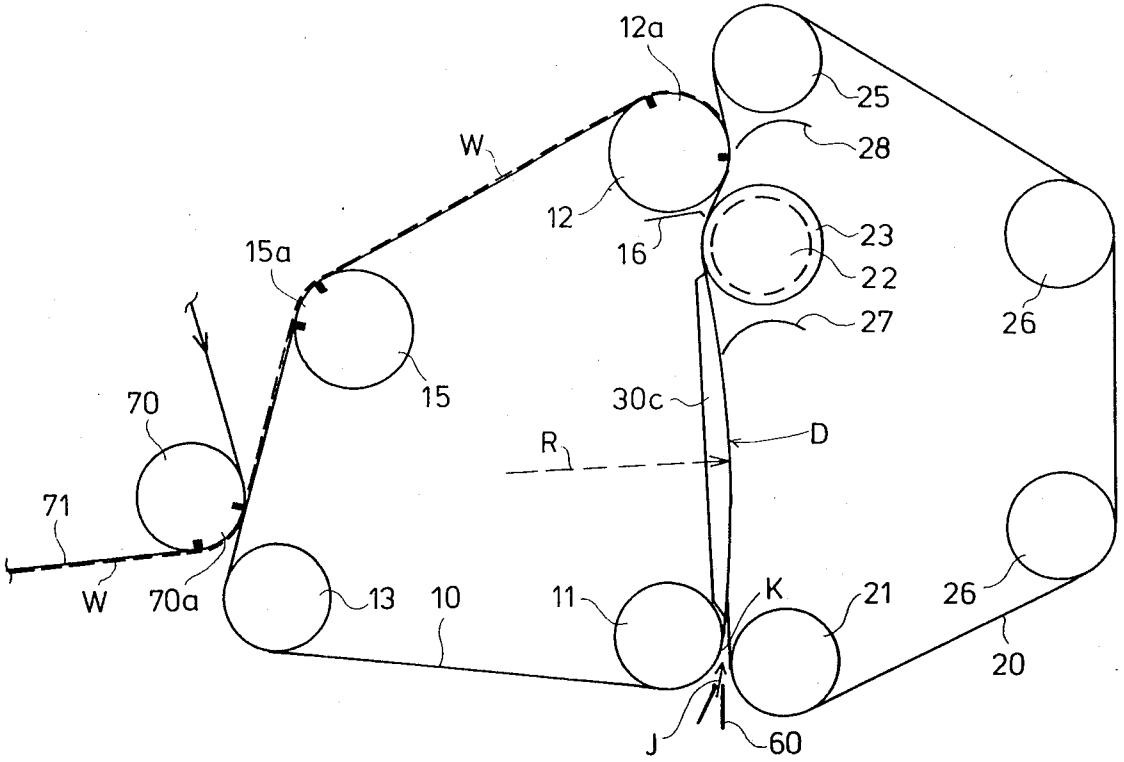
FIG. 3 is a schematic side view of still another embodiment of the invention, in which the twin-wire forming zone rises vertically.

The former shown in FIGS. 1, 2 and 3 includes a carrying wire 10 and a covering wire 20, which have a joint twin-wire forming zone D. The former of the invention is a so-called gap former, in which the wires, converging towards each other as guided by breast rollers 11 and 21, define a forming gap K between the wires. The slice portion 60 of the head box feeds a pulp suspension jet J directly into the forming gap K. A forming roller 12, provided with a suction zone 12*a*, is inside the loop of the carrying wire 10. The return run of the wire 10, guided by the guide rollers 14, is after the wire 10 drive roller 13. A forming roller 22 is inside the loop of the covering wire 20, after the breast roller 21. The forming roller 22 is a dandy-roller type forming roller provided with a very open surface 23. A dewatering trough 24, which covers the sector b of the roller 12, is provided after the forming roller 22. In the sector b, the wires 10, 20 are curved downwards as guided by the forming roller 12. The covering wire 20 is passed to its return run, which is guided by the guide rollers 26, via the reversing roller 25.

A forming board 30 is provided after the forming gap K between the wires 10 and 20, inside the loop of the carrying wire. The forming board is denoted in FIG. 1, by reference numeral 30*a*, in FIG. 2, by reference numeral 30*b*, and in FIG. 3, by reference numeral 30*c*. The forming board 30 extends from the range of the gap K to the forming roller 22. The forming board 30, which is all the aforementioned forming boards 30*a*, 30*b* and 30*c*, has a certain relatively large curve radius R, whose center of curvature is placed at the side of the carrying wire 10. The dewatering equipment at the forming board 30 may vary within quite wide limits, and some examples of different embodiments of equipment are shown in FIGS. 4, 5, 6 and 7. The centrifugal forces are relatively low at the forming board due to the large curve radius R, so that there is no splashing. As is well known, the dewatering pressure between the wires 10 and 20 is calculated from an equation $P=T/R$, wherein T=tension of the covering wire 20, and R=the curve radius of the forming board 30.

Regarding the operation of the forming board 30, the details of which are hereinafter discussed, it should be stated in this connection that water is removed from the pulp web being formed onto the surface of the covering wire 20. However, with a large curve radius R, the water does not fly apart from the wire in the position of the forming board shown in FIG. 1, because the gravitation and surface tensions of the liquid outweigh the centrifugal force. This "floating" of water may, in certain paper qualities, be favorable for the structure and properties of the upper portions of the web. The length L of the forming board 30 is, as a rule, within the range of 2 to 5 m. The curve radius R is usually within the range of R=5 to 50 m; most commonly the applications are found within the range of R=10 to 20 m.

The foregoing curvature R of the twin-wire forming zone D at the forming board 30 also has the important effect that the wires 10 and 20 maintain their posture in the lateral direction, and said wires are not formed into wavelike bag formations, which might occur in a straight twin-wire run.

The former of the present invention is a so-called full-gap former, and does not have a single-wire initial portion, which provides certain advantages. When the pulp suspension jet J is fed straight into the gap K, no detrimental transverse flows are generated, but the jet is immediately "supported" between the wires 10 and 20. The orientation of the fibers may be controlled by adjustment of the speed of the jet J relative to the speed of the wires 10, 20.

Dewatering occurs via the carrying wire 10 after the gap K, within the twin-wire portion D. Dewatering usually occurs via both wires 10 and 20, due to the tensioning pressure of the wire 10, in the sector a of the forming roller 22, the magnitude of this sector being within the range of a=1° to 50°, usually within the range of 5° to 25°. Most of the water running along in the meshes of the covering wire 20 and on the inside surface of its meshes, has access through the open surface 23 of the forming roller 22, and this water flies from the forming roller 22 into the dewatering trough 24 due to the effect of centrifugal force. The magnitude of the sector b of the forming roller 12 is within the range of 10° to 90°, usually within the range of 30° to 60°. The water drained within the sector b is passed into the trough 24, and from there to the sides of the forming section. The suction zone 12*a* of the forming roller 12 ensures that the web W follows along with the carrying wire 10.

If the forming roller 12 of FIGS. 1, 2 and 3 is not provided with a suction zone 12*a*, but operates as an open-surfaced or smooth-surfaced forming roller, a separate wire-suction roller with a corresponding wire coverage is required inside the wire loop 10 before the web is transferred into the press section (cf. the suction roller 15 in FIG. 3). In such case, it is possible to use dry suction boxes inside the wire loop 10 on the wire run between the forming rollers 12 and the separate suction roller, in order to ensure the transfer of the web and to increase the dry solids content.

The twin-wire portion, that is, the wires 10 and 20 run substantially together, starts at line A and ends at line B. The web W is detached from the carrying wire 10 in the suction zone 70*a* of the pick-up roller 70 and transferred to the pick-up felt 71, on which the web W is passed further, in a known manner, into the press section of the paper machine.

The aforedescribed forming roller 22, which is preferably a dandy-roller type forming roller, improves the base of the web W by causing an increase in the pressure in the web and shear forces out of the web, as well as removing water in the aforedescribed manner. The combined forming and suction roller 12 removes water, by the effect of the tension of the wire 20, through both of the wires and, by the effect of the suction 12*a*, through the wire 10. If required, it is possible to use suction boxes on the straight run of the carrying wire 10 between the forming and suction roller 12 and the drive roller 13.

The diameter of the forming roller 22 is preferably rather large, 1 to 2 m. The diameter of the forming and suction roller 12, which affects the centrifugal force by which water is removed through the covering wire 20, is usually smaller than that of the forming roller 22, that is, within the range of 0.2 m to 1.5 m. These diameters also depend upon the mechanical strains, for example, on the covering angles a and b.

The length L of the twin-wire draining or forming zone D between the forming gap K and the forming roller 22, in which zone the dewatering equipment 30 is placed, is usually within the range of L=2 m to 6 m. A so-called wedgewise narrowing gap is usually used as the gap K. The length of the gap K, as calculated from a plane extending through the axes of rotation of the breast rollers 11 and 21, up to the line A, may be from less than 0.5 m to about 1 m.

The operation of the gently curved forming zone D placed at the forming board 30 and the dewatering equipment provided within the zone D are hereinafter described with reference to FIGS. 4 to 7. Generally speaking, the zone D consists of one or several deck surfaces tensioning the wires 10, 20 with a curve radius R. The openness of the deck surface varies from an almost closed curved deck to a highly open deck construction, assembled from rib-like members, for example. In any case, even the individual ribs or deck surfaces are grouped so as to provide the wires 10, 20 in the forming zone D with a relatively gentle curve radius R, which is as hereinbefore stated, usually within the range of R=5 m to 50 m, preferably 10 m to 20 m. Thus, the centrifugal forces acting in the forming zone D remain low even at high velocities v. The dewatering and formation are promoted in the zone D by the pressure pulsation generated by the alternate open spaces and closed deck surfaces.

Figure 4:
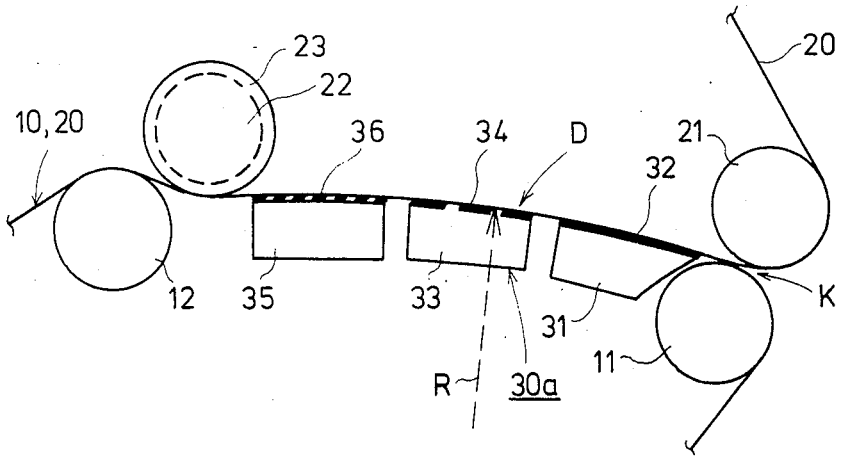
FIG. 4 is a schematic diagram of an embodiment of the twin-wire forming section and an embodiment of dewatering equipment placed inside the carrying wire loop in the twin-wire forming zone.

The forming board 30*a*, shown in FIG. 4, and placed in the forming zone D, comprises a forming shoe 31 of a large curve radius R immediately after the gap K. The forming shoe 31 is provided with a smooth-surfaced closed deck 32. After the forming shoe 31, is a forming board 33 having a curve radius R, which is provided with a rib deck 34. Open slots are provided between the ribs of the deck 34. The water may be removed through the slots downwards through the carrying wire 10. A third dewatering member of the forming board is a suction box 35, which is connected to a vacuum system and is provided with a rib deck 36 having transverse slots.

Figure 5:
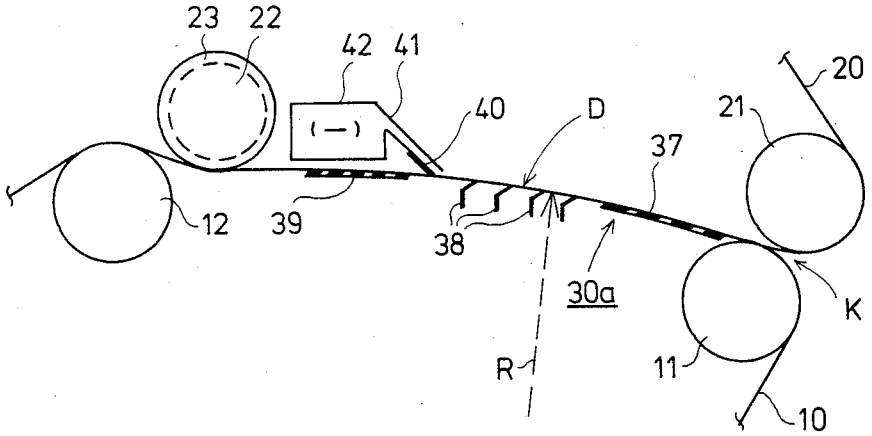
FIG. 5 is a schematic diagram of another embodiment of the dewatering equipment.

In FIG. 5, the forming board 30*a* in the forming zone D comprises a rib deck 37 of a certain curve radius R, which is placed immediately after the gap K. The rib deck 37 is provided with transverse open slots between the ribs. A curved shoe, consisting of narrow scraping ribs 38, is provided on the deck 37. A deflector 40 is provided after the shoe 38, inside the loop of the covering wire 20. The deflector 40 is connected via the duct 41 to a suction box 42, which, in turn, is connected to the vacuum system of the paper machine.

Figure 6:
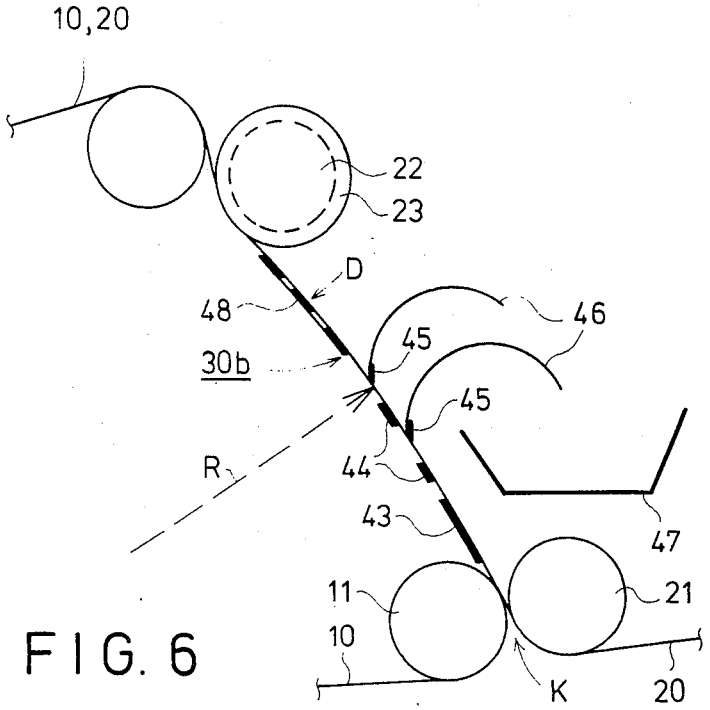
FIG. 6 is a schematic diagram of an embodiment of twin-wire dewatering equipment in a twin-wire forming zone which rises diagonally upward, as shown in FIG. 2.

In FIG. 6, the upwardly slanting forming zone D, rising at an angle of about 40° to 60°, comprises a closed-surface forming deck 43 inside the carrying wire 10 and thereinafter forming ribs. Deflectors 45 are provided at the forming ribs, inside the loop of the covering wire 20, and curved guide surfaces 46 are connected to said deflectors and guide water drained through the meshes in the wire 20 into the collecting trough 47. There is a rib deck 48 after the deflectors 45, inside the wire 10.

The curve radius R does not have to remain unchanged throughout the entire length of the forming zone D. In one possible embodiment, the curve radius is changed continuously or stepwise so that at the end of the forming zone D, next to the gap K, the curve radius is near the upper limit of the range of variation of R=5 to 50 m, and at the final end of said zone, closer to the lower limit. In this way, the dewatering pressure can be increased gradually, and the dewatering made very gentle.

When the run of the wire is closer to horizontal (FIG. 1) than to vertical, the water passing through the covering wire 20 can be collected by a separate collecting device, such as a suction box 42 connected with a deflector 40, as in FIG. 5, or the water passing through the wire 20 may be allowed to "float" on said wire and pass through the former roller 22 of a very open surface structure 23, whereupon the water flies, as thrown by centrifugal forces, into dewatering troughs or collecting basins 24 (FIG. 1). The latter mode of removal of the water is possible, because the initial dewatering zone constructed with a larger curve radius R, as compared with the solutions accomplished in the prior art, does not, by means of its centrifugal force, throw the water drained upwards, so that it flies high up. Thus, with a radius R=30 m, for example, the limit velocity at which the centrifugal force surpasses the force of gravitation is $$v = \sqrt{gR} = \sqrt{9.81 \times 30\ \text{m/s}} = 17.2\ \text{m/s}$$

In reality, the limit speed v is even somewhat higher than that calculated above, because the surface tension and capillary forces of water in the meshes of the wire 20 increase the adhesion of the water to said wire considerably. It can be estimated that the water does not start flying apart from the wire with a radius R=30, even at a speed of almost 25 m/s.

Another advantage that is obtained with the large curve radius R at the same time is the very gentle dewatering, due to the low dewatering pressure P=T/R. The gentle dewatering is for the purpose of attaining high retention and, at the same time, versatile control of the formation process, because the dewatering has been timed on a relatively long distance. As in known in the prior art, the more highly pressurized dewatering in gap formers occurs within such a short distance that the process cannot be controlled in practice. However, the process is self-controlling, that is, it depends only on pulp conditions and grammage, for example.

The dewatering pressure P=T/R, and P=5/20 kPa=0.25 kPa, when R=20 m and T=5 kN/m. Ordinarily, in the prior art embodiments of gap formers, the pressure is 1 to 10 kPa, and even the negative foil pressures used in fourdrinier machines are of the same order of magnitude.

The elements of the forming boards 30 may be at least partly adjustable so that the pressing of the individual members perpendicularly against the wires 10, 20 may be varied, so that the pressure pulse of the member concerned may be adjusted thereby. Likewise, the positions of successive members can be varied, so that the main curve radius of the wire run is changed to some extent. Relatively little plays are required in order to change the curvature of large curve radii, within the range of R=5 m to ∞, for example. The length of the straight portion is, however, limited by the necessity for tensioning the wires 10, 20 in arch form, required as the posture for preventing wrinkling of said wires.

If desired, the dewatering effect can also be intensified by negative pressure by using auxiliary suction in a box provided with a slotted deck, or by placing ribs at the foil angles, as is done, in a manner known in the prior art, with fourdrinier wires. It is also possible to use so-called deflectors at one or both sides of the wires 10, 20, as is shown in FIGS. 5 and 6. A deflector is defined to be a relatively narrow-tipped rib or doctor pressing the wire. As shown in FIG. 5, auxiliary suction in the form of the suction box 42 is used in the deflector 40 placed inside the loop of the covering wire 20 in order to facilitate the collecting of water. A curved forming surface may also be constructed of wider unified solid or slotted decks and of different combinations of same, as shown in FIGS. 4, 5 and 6. When deflectors 40 and 45 are used inside the loop of the covering wire 20, the main curvature of the wires 10, 20 at said deflectors momentarily becomes a straight line, or even a negative curvature (R<0), wherein the center of curvature is shifted to the side of the loop of the covering wire 20, within this limited area.

Figures 7, 7A, 7B:
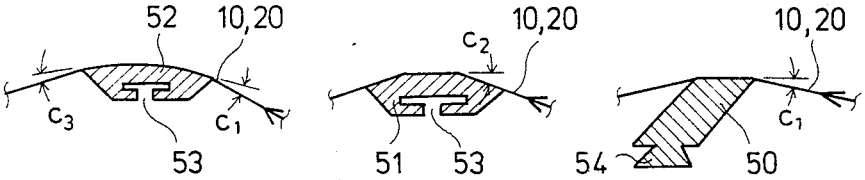
FIGS. 7*a, b* and *c* are cross-sectional views of different embodiments of deck ribs which are placed in the twin-wire forming zone and which determine the running of the wires.
Figure 8A:
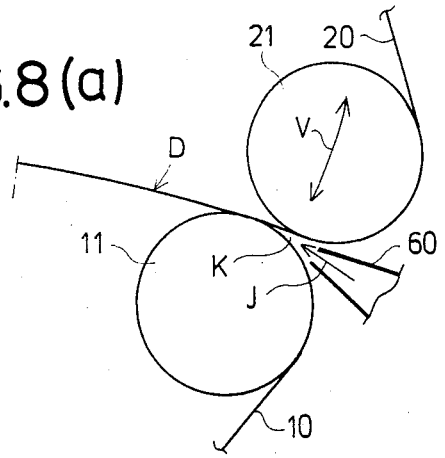
FIGS. 8*a, b, c, d* and *e* are schematic diagrams of different arrangements of the forming gaps into which pulp suspension is fed.
Figure 8B:
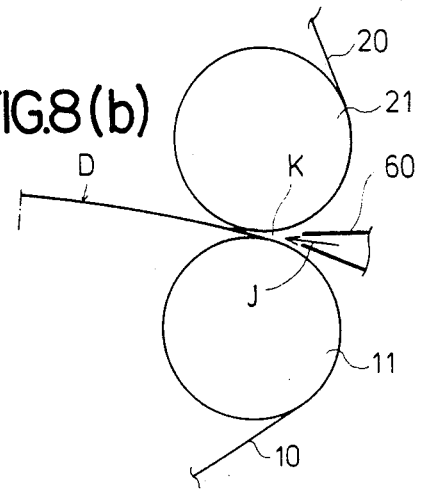
Figure 8C:
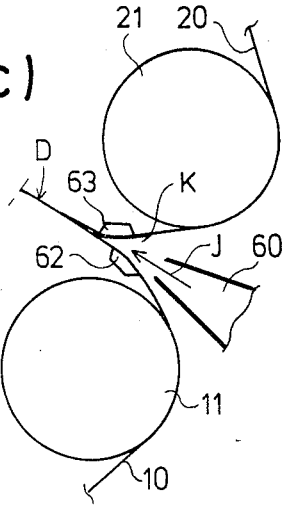
Figure 8D:
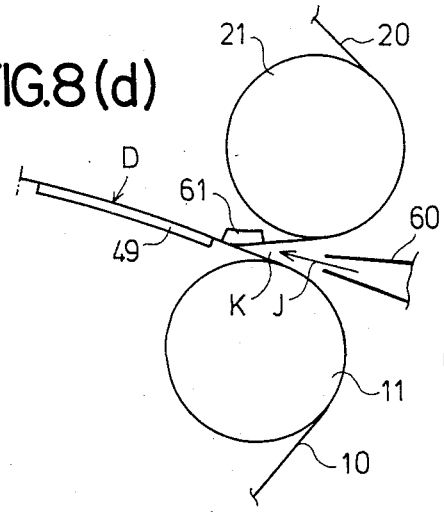
Figure 8E:
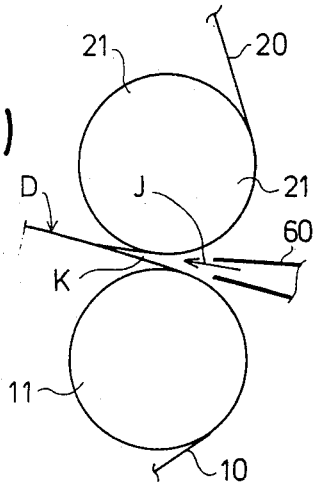

FIG. 7 shows some examples of the deck ribs forming a curved wire run. Pressure peaks and additional pulsations can be produced in the pulp web W formed, due to the effect of an angular run of the wires 10, 20. This angular run is illustrated in FIG. *7a* by the angles $c_1$ and $c_3$, in FIG. *7b* by the angle $c_2$, and in FIG. *7c* by the angle $c_1$. As shown in FIG. *7a*, the rib 52 has a uniformly curved guide surface. The rib is affixed to the forming board by a groove 53, for example. The rib 51 of FIG. *7b* is provided with an edged guide surface. FIG. *7c* shows a narrower rib 50 of the deflector type, which is affixed to the forming board by a dovetail portion 54.

The gap K is preferably adjustable, so that the penetration of the headbox jet J between the wires 10, 20 can be controlled.

In FIG. *8a*, the gap K is formed by a light wire nip against the breast roller 11. The upper wire 20 contacts the breast roller 11 of the lower wire 10. The gap K can be adjusted by a height adjustment of the breast roller 21 of the upper wire 20, as indicated by an arrow V. The breast roller 11 of the lower wire 10, constituting the counter roller of the wire nip or gap, may be open or smooth-surfaced.

As is shown in FIG. *8b*, the breast roller 21 of the upper wire 20 forms the gap or nip against the lower wire 10. The gap K is adjusted by a height adjustment of the upper and/or lower wire 10, 20.

The gap arrangement shown in FIGS. *8a* and *8b* may also be modified so that the roller forming the gap K does not quite contact the opposite wire, but a gap-like slot remains between the roller an the wire. The slot is completely filled by the discharge jet, whereby pressure is produced, or the nip proper and the formation of pressure start slightly after this position (FIG. *8e*). In FIGS. *8a* and *8b*, in addition to the aforedescribed modes, the narrowing of the wires 10, 20 in the gap K can be adjusted by rib-shaped members 62 and 63, as shown in FIG. *8c*, considerably more sharply curved than the beginning dewatering and forming zone D, either from one or both sides of the wires 10, 20. In this case, the wires 10, 20 are brought close to each other to form a gap K narrowing in accordance with the draining of water, and the starting point of the nip, that is, the point at which the tension of the wires 10, 20 starts producing pressure on the pulp web, can be adjusted. The direction of the headbox jet J may be adjusted to the side of either one of the wires 10, 20, or to the middle of the gap K, besides the controls shown in the FIGS.

As shown in FIG. *8d*, a rib-shaped, curved member 61 is in the gap, against the loop of the wire 20. After the rib-shaped curved member 61, against the inside surface of the wire 10, is a member 49 provided with a closed deck, at least in the initial part, within the area of the gap K.

The invention is by no means restricted to the aforementioned details which are described only as examples; they may vary within the framework of the invention, as defined in the following claims.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In a paper machine, a process in the forming of paper web and in the dewatering of pulp web and of paper web being formed, comprising the steps of:

feeding a pulp suspension jet from a headbox slice into a gap formed by a looped carrying wire and a looped covering wire, said looped carrying and covering wires having joint runs defining a twin-wire forming zone which begins immediately following said gap and in which a pulp web is formed;

passing said twin-wire forming zone over dewatering means situated within the loop of said carrying wire for imparting a first gently curved configuration to an initial portion of said twin-wire forming zone immediately following said gap, the curve defined by said first curved configuration having a radius of a length in the range of between about 5 to 50 meters and extending to the side of said carrying wire so that said initial portion of said twin-wire forming zone is curved towards the carrying wire loop, by which centrifugal forces acting on the pulp web in said initial portion of said twin-wire forming zone passing over said dewatering means is insufficient to cause substantial splashing at an inner face of said covering wire loop;

passing an intermediate portion of said twin-wire forming zone over a sector of an open-faced first forming roller situated within the loop of said covering wire substantially immediately after said dewatering means to impart a second curved configuration to said intermediate portion of said twin-wire forming zone which is curved towards said covering wire loop;

passing a subsequent portion of said twin-wire forming zone over a sector of a second forming roller situated within the loop of said carrying wire substantially immediately after said first forming roller to impart a third curved configuration to said subsequent portion of said twin-wire forming zone which is curved towards said carrying wire loop in the same direction as the curvature of the initial portion; and detaching the formed web from said forming wire and transferring the web into a press section of the paper machine.

2. A process as claimed in claim 1, wherein said curve radius of said first curved configuration of said twin-wire forming zone is within a range of between about 10 to 20 meters.

3. A process as claimed in claim 1, wherein said curve radius of said first curved configuration of said twin-wire forming zone is selected so that the dewatering pressure therein is substantially less than about 1 kPa and so that the tension of said carrying and covering wires is of the order of 5 kN/m.

4. A process as claimed in claim 1, further comprising the step of providing pressure pulsation in the pulp web being formed in said twin-wire forming zone.

5. A process as claimed in claim 1, wherein said paper machine further includes a dewatering trough, said process further comprising the steps of transferring water present at the inside surface of the mesh of said covering wire and in the meshes of said wire substantially through or past the open surface of the said first-open faced forming roller via said first open-faced forming roller and removing said water, as thrown by centrifugal forces, over said second forming roller into the dewatering trough inside the loop of said covering wire.

6. A process as claimed in claim 1, wherein said paper machine further includes a suction zone on said second forming roller and a pick-up device, said process further comprising the steps of removing water by negative pressures prevailing in the suction zone at least through said carrying wire and additionally insuring via said negative pressures that, after the twin-wire portion, the web follows along with said carrying wire and detaching said web from said carrying wire via the pick-up device.

7. A process as claimed in claim 1, wherein said paper machine further includes a suction zone on said second forming roller, said process further comprising the steps of deflecting said carrying and covering wires of said intermediate portion of said twin-wire forming zone over an angle in the range of between about 1° to 50° on said first open-faced forming roller, and deflecting said carrying and covering wires of said subsequent portion of said twin-wire forming zone over an angle in the range of between about 10° to 90° on said second forming roller having a suction zone.

8. In a paper machine, apparatus for forming a paper web and dewatering a pulp web and a paper web being formed, comprising:

a headbox slice;

a looped carrying wire;

a looped covering wire;

said looped carrying and covering wires defining a gap located to receive a pulp suspension jet from the headbox slice, said carrying and covering wires having joint runs defining a twin-wire forming zone beginning immediately after said gap in which a pulp web is formed;

dewatering means situated within the loop of said carrying wire for imparting a first gently curved configuration to an initial portion of said twin-wire forming zone immediately following said gap, the curve defined by first curved configuration having a radius of a length in the range of between about 5 to 50 meters and extending to the side of said carrying wire so that said initial portion of twin-wire forming zone is curved towards the carrying wire loop, by which centrifugal force acting on the pulp web in said initial portion of said twin-wire forming zone passing over said dewatering means is insufficient to cause substantial splashing at an inner face of said covering wire loop;

an open-faced first forming roller situated within the loop of said covering wire substantially immediately after said dewatering means over a sector of which an intermidiate portion of said twin-wire forming zone passes to impart a second curved configuration to said intermediate portion of said twin-wire forming zone which is curved towards said covering wire loop; and a second forming roller situated within the loop of said carrying wire substantially immediately after said first forming roller over a sector of which a subsequent portion of said twin-wire forming zone passes to impart a third curved configuration to said subsequent portion of said twin-wire forming zone which is curved towards said carrying wire loop in the same direction as the curvature of the initial portion.

9. The combination of claim 8 wherein said dewatering means includes at least one dewatering member situated within said carrying wire loop of the group consisting of a forming shoe having a closed deck, a forming shoe having a ribbed deck, a suction box having a ribbed deck, a suction box having a perforated deck and connected to a vacuum system, a deck having a curvature and consisting of ribs, and a curved shoe having narrow ribs.

10. The combination of claim 9 wherein said dewatering means further includes dewatering deflectors situated within said covering wire loop and duct means for connecting said deflectors to a suction system.

11. The combination of claim 8 wherein said second forming roller consists of a combined forming and suction roller having a suction sector over which the joint run of said carrying and covering wires is curved towards the loop of said carrying wire.

12. The combination of claim 8 wherein said radius of said first curved configuration has a length in the range of between about 10 meters to 20 meters.

* * * * *